US008677789B2

(12) United States Patent
Gracia Bobed et al.

(10) Patent No.: US 8,677,789 B2
(45) Date of Patent: Mar. 25, 2014

(54) PLASTIC SUDS TUB FOR A WASHING MACHINE OR A WASHER/DRYER

(75) Inventors: Ismael Gracia Bobed, Saragossa (ES); Christian Quandt, Falkensee (DE); Holger Reichner, Prenzlau (DE); Wilfried Wildung, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 559 days.

(21) Appl. No.: 12/677,121

(22) PCT Filed: Sep. 19, 2008

(86) PCT No.: PCT/EP2008/062492

§ 371 (c)(1), (2), (4) Date: Mar. 9, 2010

(87) PCT Pub. No.: WO2009/040302

PCT Pub. Date: Apr. 2, 2009

(65) Prior Publication Data

US 2010/0192640 A1 Aug. 5, 2010

(30) Foreign Application Priority Data

Sep. 20, 2007 (DE) ..... 10 2007 044 882
Feb. 22, 2008 (ES) ..... 200800611

(51) Int. Cl.
*D06F 37/26* (2006.01)

(52) U.S. Cl.
USPC ..... 68/140; 68/232

(58) Field of Classification Search
USPC ..... 68/3 R, 232, 139, 140, 142; D32/29
See application file for complete search history.

(56) References Cited

U.S. PATENT DOCUMENTS

| | | | | |
|---|---|---|---|---|
| 5,329,791 | A | 7/1994 | Cargnel et al. | |
| 5,699,682 | A * | 12/1997 | Durazzani | 68/140 |
| 5,965,236 | A * | 10/1999 | Durazzani | 428/156 |
| 6,077,907 | A * | 6/2000 | Raetzsch et al. | 525/191 |
| 6,279,357 | B1 * | 8/2001 | Didlick et al. | 68/20 |
| 6,539,753 | B1 | 4/2003 | Ito et al. | |
| 7,578,151 | B2 * | 8/2009 | Blomberg et al. | 68/142 |
| 2005/0092034 | A1 * | 5/2005 | Hollenhorst et al. | 68/275 |
| 2006/0125150 | A1 | 6/2006 | Gomez Caudevilla et al. | |
| 2007/0062225 | A1 * | 3/2007 | Fechtel et al. | 68/3 R |

(Continued)

FOREIGN PATENT DOCUMENTS

| | | | |
|---|---|---|---|
| DE | 3512137 | A1 | 10/1985 |
| DE | 19952991 | A1 | 5/2001 |

(Continued)

OTHER PUBLICATIONS

European Patent Office 0 097 483 Jan. 1984.*

(Continued)

*Primary Examiner* — Joseph L Perrin
(74) *Attorney, Agent, or Firm* — Nixon & Vanderhye, P.C.

(57) ABSTRACT

A plastic suds tub for a washing machine includes a cylindrical casing, an end face wall closing off the casing with a hollow-cylindrical, solid bearing mount, a stabilizer on the end face wall of a more solid and higher-quality plastic than the casing, and reinforcement ribs molded into the stabilizer or end face wall. The reinforcement ribs being radially-aligned from the bearing mount and branching along their radial extent.

21 Claims, 4 Drawing Sheets

(56) References Cited

U.S. PATENT DOCUMENTS

| | | | | |
|---|---|---|---|---|
| 2007/0068199 | A1* | 3/2007 | Dahlmann et al. | 68/30 |
| 2007/0245776 | A1 | 10/2007 | Reinwald | |
| 2008/0033112 | A1* | 2/2008 | Squire et al. | 525/240 |
| 2009/0318597 | A1* | 12/2009 | Squire et al. | 524/261 |

FOREIGN PATENT DOCUMENTS

| | | | | |
|---|---|---|---|---|
| DE | 202004012221 | U1 | | 11/2004 |
| EP | 1528136 | A2 | | 5/2005 |
| GB | 2189511 | A | | 10/1987 |
| GB | 2 272 913 | | * | 6/1994 |
| GB | 2 333 300 | | * | 7/1999 |
| WO | 2007113228 | A1 | | 10/2007 |

OTHER PUBLICATIONS

European Patent Office 0 374 519 Jun. 1990.*
European Patent Office 1 035 247 Sep. 2000.*
Washington Penn Plastic Co., Inc., Glass Reinforced Polypropylene, pp. 1-3, no date.*

* cited by examiner

PLASTIC SUDS TUB FOR A WASHING MACHINE OR A WASHER/DRYER

BACKGROUND OF THE INVENTION

The invention relates to a plastic suds tub for a washing machine, especially for a washing machine with a front opening for loading and unloading the laundry, which plastic suds tub has a cylindrical casing and an end face wall closing off the casing with a hollow-cylindrical, solid bearing mount for a bearing of a shaft of a laundry drum able to be rotated in the tub as well as means for stabilization.

The invention is based on a washing machine with a housing and a washing assembly suspended on springs within said housing, with the washing mechanism containing a cylindrical plastic suds tub, a washing drum supported to allow it to rotate therein, the axis of which has an essentially horizontal alignment, and a drive motor which drives the laundry drum directly or from outside via an intermediate belt pulley. The end face wall of the suds tub has a bearing mount to support the drum shaft.

Enormous rotational and bending forces arise during the operation of the washing machine, especially during spinning, which are generated by the rotational movement of the laundry drum and are transmitted to the suds tub. The loading on the suds tub increases with the size of the drum and the amount of the laundry loaded into it. The dynamics of the forces acting on the tub depend on the speed of rotation of the washing drum, the effect of the force on the tub increases especially when the drum is starting to rotate.

In front-loading washing machines the drum is supported on one side. In these washing machines known as front loaders the bending and rotational forces transmitted by the laundry drum must be taken up by the bearing mount in the end face wall of the tub and transmitted or distributed over the full surface of the latter. The requirements relating to mechanical durability are especially high with this washing machine type. Such a suds tub must be constructed to be strong enough to withstand all stresses over the long term, whereby consideration should be given for the construction of the tub to the fact that the mechanical stress is at its highest in the area of the bearing mount and reduces outwards from the bearing mount via over end face wall to the tub casing.

Assuming that the lifetime of a washing machine is more than 10 years, a tub must be designed so as to be able to fulfill all functional requirements over a this period of time, especially as regards its ability to withstand the mechanical stresses transmitted by the drum, as well as in relation to watertightness and corrosion resistance.

Another requirement for a modern mass product such as washing machines is that the individual components, such as the tub in the present case, must not only fulfill the functional requirements but must also be cost effective to manufacture as well as be able to be recycled without any problems once the washing machine has reached the end of its life.

So that the tub can fulfill all functional requirements over the long term, especially that of being sufficiently mechanically stable in relation to mechanical stresses, tubs for washing machines are known from the prior art in which numerous forms of means to stabilize the tub are also employed.

A particular tub construction is proposed in DE 199 52 991 A1. To optimize the tub in relation to the mechanical forces to be introduced and dissipated, the tub is constructed from an inner section made from a material resistant to washing liquor such as stainless steel or plastic and an outer section in the form of a supporting construction for accepting forces and for distributing the mass of the assembly.

Translating this type of construction into production is associated with a significant outlay in material and is also very demanding in terms of technology. Overall such a tub is not suited to economic mass production.

Tubs with a metallic bearing cross in their end face wall are in widespread use. An example of such a tub is disclosed in publication EP 1 528 136 A2. In this document it is proposed that a support contour, preferably made of cast iron, be arranged in the area of an end face wall, in the center of which a bearing seat is arranged for flying support of the drum by receiving a shaft support connected to the drum, with the support contour being at least embedded almost fully in the material of the end face surface. To securely dissipate forces and high temperatures from the support area the bearing contour possesses at least one or more arms running radially.

A known method of manufacturing these plastic tubs by injection molding is to first arrange the support cross in the injection machine mold and then undertake the injection itself. Insert-molding of the support cross makes it possible to seat it firmly in the end face wall.

The methods for manufacturing tubs with an insert-molded support cross are technologically demanding and expensive. In addition the injection molding methods also exhibit a number of problems and disadvantages which stem from the fact that materials are used that have very different properties.

Since the known tubs on the one hand involve a container made of plastic and on the other hand a support cross made from metal, their different material properties have a disadvantageous effect on the cooling-down process after injection molding such that, as a result of the different coefficients of expansion and the different thermal transfer capabilities, numerous stresses are produced after the metallic support cross is molded into the tub which are the result of the plastic shrinking when it cools down to room temperature.

The forces which act on the support cross in such cases are so great that the support cross can distort. A major disadvantage is that cracks can form in the plastic and the two different materials can came away from each other at the boundaries between them, which can lead after a longer period of operation to failure of the tub seals and to the support cross becoming loose in the end face wall. A further problem lies in the fact that the plastic inside the material cools down at a different rate from that at the boundary surface of the support cross. As a result micro gaps form between the plastic and the support cross, which worsens the connection between the materials and can lead to the formation of cracks.

A tub can be found in WO 2004/042133 A1 which has a metallic bearing shell which accommodates a member made of plastic during injection molding which is more solid and of better quality than the plastic forming the container. The metallic bearing shell and the plastic member form a unit onto which the plastic tub is injection molded during a further process step.

This method is designed to counter the formation of cracks in the area of the bearing mount described above. The proposed construction offers the further advantage that the additional member made from more solid plastic gives the tub a higher mechanical stability in the area of the bearing mount. The disadvantage of the construction lies in the stabilizing effect of the additional member being restricted to the area of the bearing mount. The solid plastic member has no effect, or only an insignificant effect on the stability of other areas of the tub, especially the end face wall of the tub containing the bearing mount.

As an alternative to the plastic tubs described with the support cross integrated into the end face wall, types have been developed with stabilizing means consisting of plastic.

The unification of the technology that this makes possible produces not insignificant rationalization potential, with the technical and financial effort involved in manufacturing the tub being significantly reduced.

For example a tub is described in DE 20 2004 012 221 U1 of which the rear end face wall is provided with a plurality of straight rigid ribs which are arranged at the same angular spacing from each other and starting from the through bearing mount, which is arranged in the middle of the rear end face wall, run radially outwards to the outer edge of the rear end face wall.

Tubs are also known which in the area of the interface wall, in addition to the radial reinforcement ribs, feature serpentine, star, oval, circular or spherically molded-in stress relief profiles. The profiles are designed so as to be well suited to forces running in a number of directions.

Such tubs exhibit a greater rigidity compared to the example given above. The disadvantage of these tubs is that accumulations of material occur in the areas where the different stress relief profiles cross over each other, which as a result of the different temperature gradients in some areas, causes the material to shrink differently after injection molding. The result is material stresses within the end face wall with the resulting danger that cracks can form in the material and after a longer period of operation to the seals of the tub failing.

The known constructions of tubs with stabilization means made of plastic described are not able to be used or only able to be used to a restricted extent for larger load volumes and very high spin speeds.

The rigidity of a tub constructed in this manner can be increased up to a certain level by designing the material strength of the end face wall and/or of the stabilization means formed into it to be higher or stronger or by using more solid plastics. Since more solid plastics essentially make the tub more expensive and strengthening the end face wall and the stress relief profiles leads to accumulations of material, relatively narrow limits are imposed on both options for strengthening the end face wall. With modern machines in particular, with spin speeds of the rotating drum of over 1500 rpm and a load of more than 8 kg, the known constructions of tub with stabilization means made exclusively of plastic are not able to be used.

BRIEF SUMMARY OF THE INVENTION

The object of the invention is to embody a tub with stabilization means made exclusively from plastic such that the stability of the tub is high enough for the demands imposed by modern washing machines to be met. It is simultaneously an object of the invention to design the construction of the tub such that the technological outlay involved in manufacturing the tub and the use of materials can be reduced to a minimum.

The plastic tub designed in accordance with the present invention for a washing machine, especially a washing machine with a front opening for loading and unloading the laundry into or from the machine, which plastic tub features a cylindrical casing and an end face wall closing off the casing with a hollow-cylindrical, solid bearing mount for a bearing of a shaft of a washing drum able to be rotated in the tub as well as means for stabilization, is characterized in that an additional stabilization component is put onto the tub from the outside as a means of stabilizing the end face wall.

The tub designed in accordance with the invention is characterized by an extraordinary rigidity. The tub is robust enough to withstand a high mechanical stresses which are transmitted from the washing drum onto the tub during the operation of washing machines with a greater drum volume and larger loads. The additional effort involved in implementing the invention is restricted to the use of an additional component made from plastic. With this additional component a lenticular hollow space, possibly subdivided into more or fewer segments separated from each other, is formed on the corresponding end face wall, possible giving a saving in material amounting to 30% to 40% of the material which would have to be expended for cavity-free reinforcement structures, especially ribs or thicker walls. The technologies for producing the additional stabilizing component and for joining the stabilizing component to the end face wall are known and can be managed without any problems.

The invention also allows a more flexible use of a given tub designed for comparatively small stresses, with the stress being determined in particular by the maximum loading capacity of laundry and a maximum spin speed for which the tub is designed. The inventive equipping of this tub with the additional stabilization component enables it to be allowed and used for a correspondingly higher stress, especially determined by an increased load capacity and/or an increased maximum spin speed.

Preferably an additional stabilization component for which a more solid and better-quality plastic is used than is used for the tub casing is put on from outside as the means of stabilizing the end of face wall.

The stabilization component and the end face wall of the tub are also preferably welded to each other. Trial results showed that talc-reinforced polypropylene is best suited as a material for the tub casing and the end face wall. This plastic is cheap and has a low modulus of elasticity. The use of glass fiber-reinforced polypropylene with a high modulus of elasticity has been shown to be favorable for the stabilization component. New materials can be easily processed by injection molding and readily welded to each other. In such cases a vibration welding method or ultrasound welding method can be used in particular.

Inventively it is also preferred for the tub casing and the stabilization components to be made of materials and which have the same polymer type as their basis in order to guarantee that the two parts can be welded together. The material of the tub casing additionally contains an inert, fine-grained filler, especially talcum, not least to make the material cheaper. The quality of the material of the stabilization component can especially be improved by having it contain less or no fine-grain filler and/or additionally fibers, especially glass fibers. Such fibers also make a significant contribution to the increased rigidity of this material.

To significantly improve the rigidity of the tub, in embodiments of the invention reinforcement ribs are molded into the stabilization component and/or into the end face wall. The reinforcement ribs of the stabilization component or of the end face wall and the surfaces of the end face wall or of the stabilization component respectively are formed correspondingly to one another in the manner in which the backs of the reinforcement ribs rest along their extent against the opposing surface without any gap and are welded to the latter along the line of contact. Advantageously the reinforcement ribs have a radial extent which in a further embodiment of the invention branches off a least once along their radial extent.

The number of the molded-in reinforcement ribs and their different dimensioning, as well as the option of selecting molding the reinforcement ribs into the stabilization component and/or into the end face wall, enables tubs of any type to be manufactured with the most effective use of materials, which have a rigidity which is precisely tailored to the specific stresses arising during the operation of the washing machine.

A likewise especially preferred embodiment of the invention makes provision for the reinforcement ribs to include radial reinforcement ribs running circumferentially, which radial circumferential reinforcement ribs are in contact with the stabilization component. In this case the bearing mount is especially in contact with the stabilization component. Also at least one closed compartment is also preferably formed between the bearing mount, the reinforcement ribs and the stabilization component in such cases.

BRIEF DESCRIPTION OF THE DRAWINGS

Exemplary embodiments of the invention are explained below in greater detail below by way of example with reference to the enclosed drawing. The figures show.

DETAILED DESCRIPTION OF EXEMPLARY EMBODIMENTS OF THE PRESENT INVENTION

Figure 1:
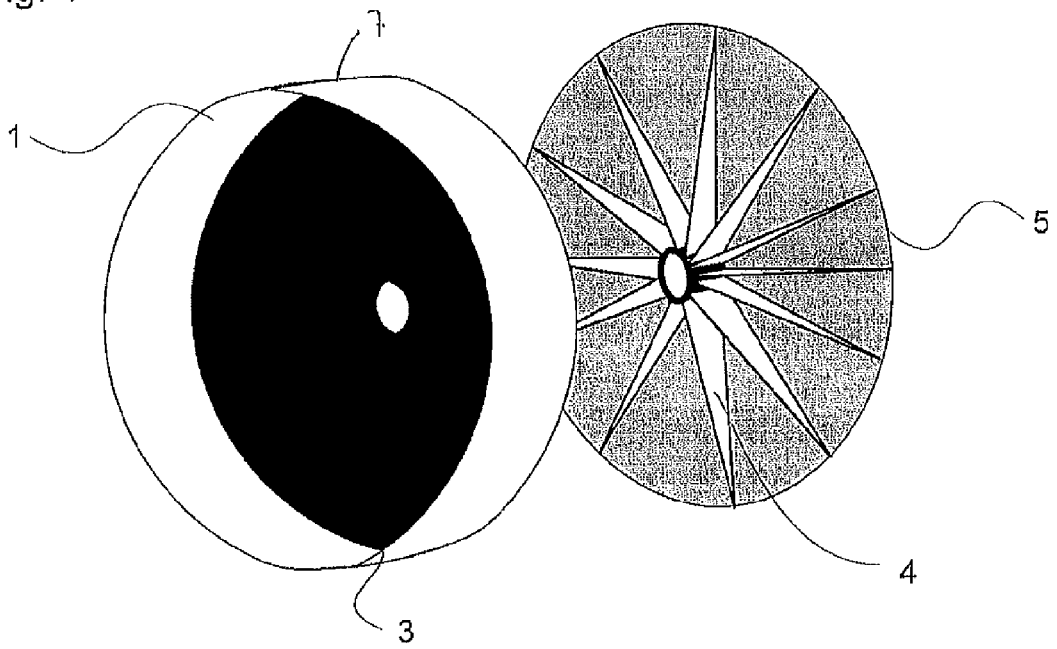
FIG. 1: a tub with a stabilization component in a perspective view, example 1.

FIG. 1 shows the rear part of a plastic tub 1 in a perspective view from the front. This component contains the end face wall 3 and is manufactured in one piece by injection molding. In a subsequent operation this component 1 is firmly connected to the cylinder of the tub 1 also made of plastic. Formed a centrally in the end face Wall 3 is a hollow-cylindrical cavity-free bearing mount 2. This is used to receive a fluid-tight bearing not shown in the figure for the drive shaft of a laundry drum also not shown in the figure arranged in the tub 1. The more detailed embodiment of the hollow-cylindrical bearing mount 2 is dictated by the correspondingly exact design of the bearing to be used, which is not of importance here. In any event the bearing mount 2 consists of compact plastic without cavities, since the bearing mount must accept the forces of the rotating washing drum possibly adversely affected by a load imbalance and must be accordingly be designed to accommodate stress and be robust.

The present characteristic additional stabilization component 5 is placed against the end face wall 3 from outside. The stabilization component 5 is made from a more solid and higher-quality plastic. Reinforcement ribs 4 are molded into the stabilization component 5 which, beginning at the bearing mount 2, extend radially out to the edge of the end face wall 3, with the height of the reinforcement ribs 4 reducing towards the edge. In the exemplary embodiment the reinforcement ribs 4 are triangular in shape.

Figure 4:
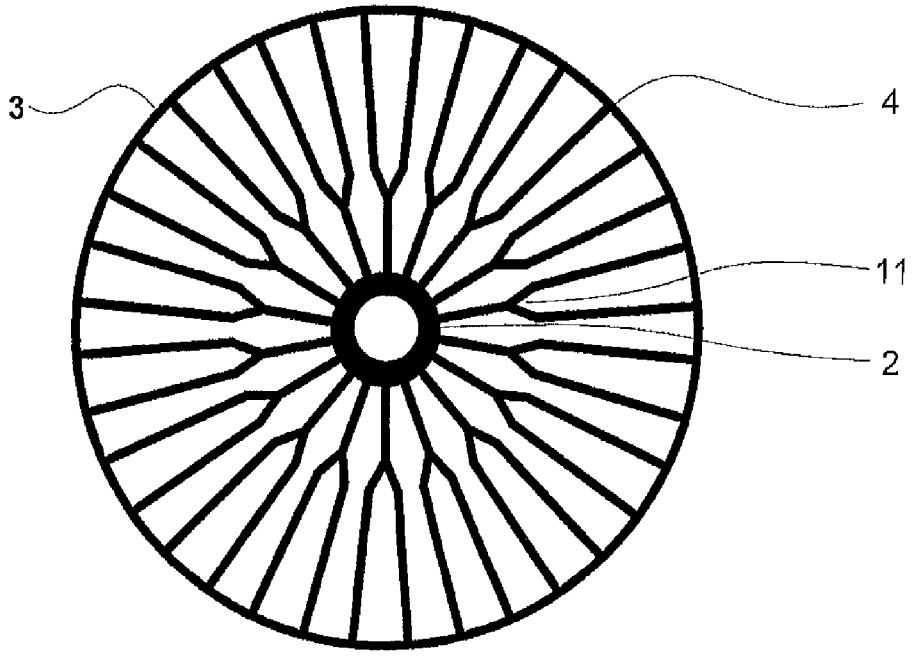
FIG. 4: a stabilization component with ribs in an overhead view.
Figure 7:
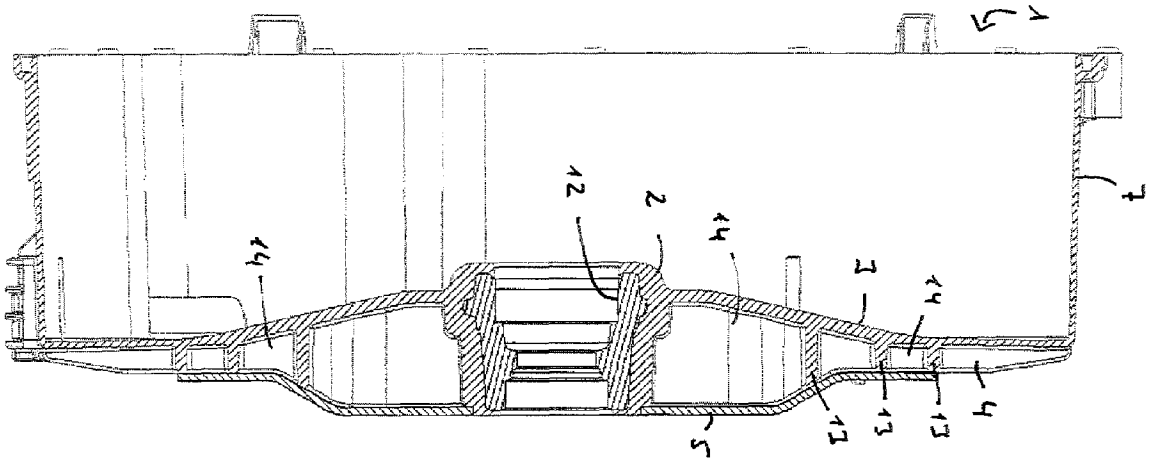
FIG. 7: the tub from FIG. 6, in section along the line A-A.
Figure 5:
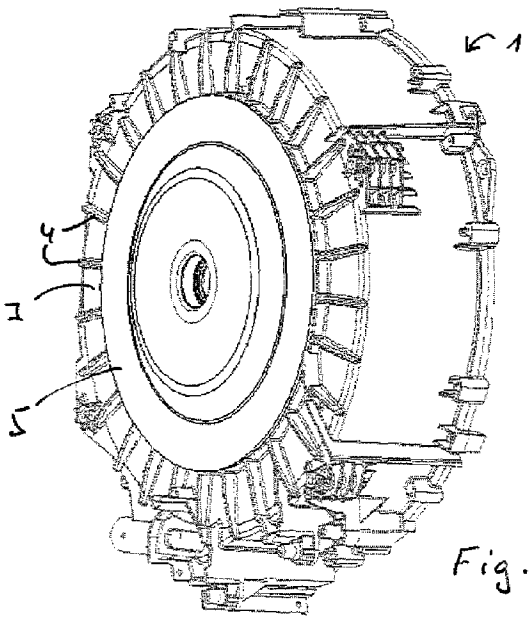
FIG. 5 a tub with a stabilization component in a perspective view, example 3.
Figure 6:
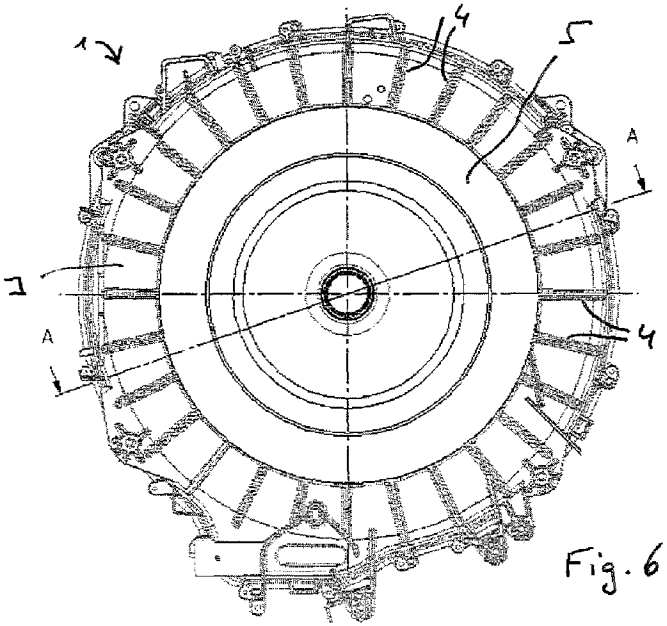
FIG. 6: the tub from FIG. 5, viewed from the rear.
Figure 8:
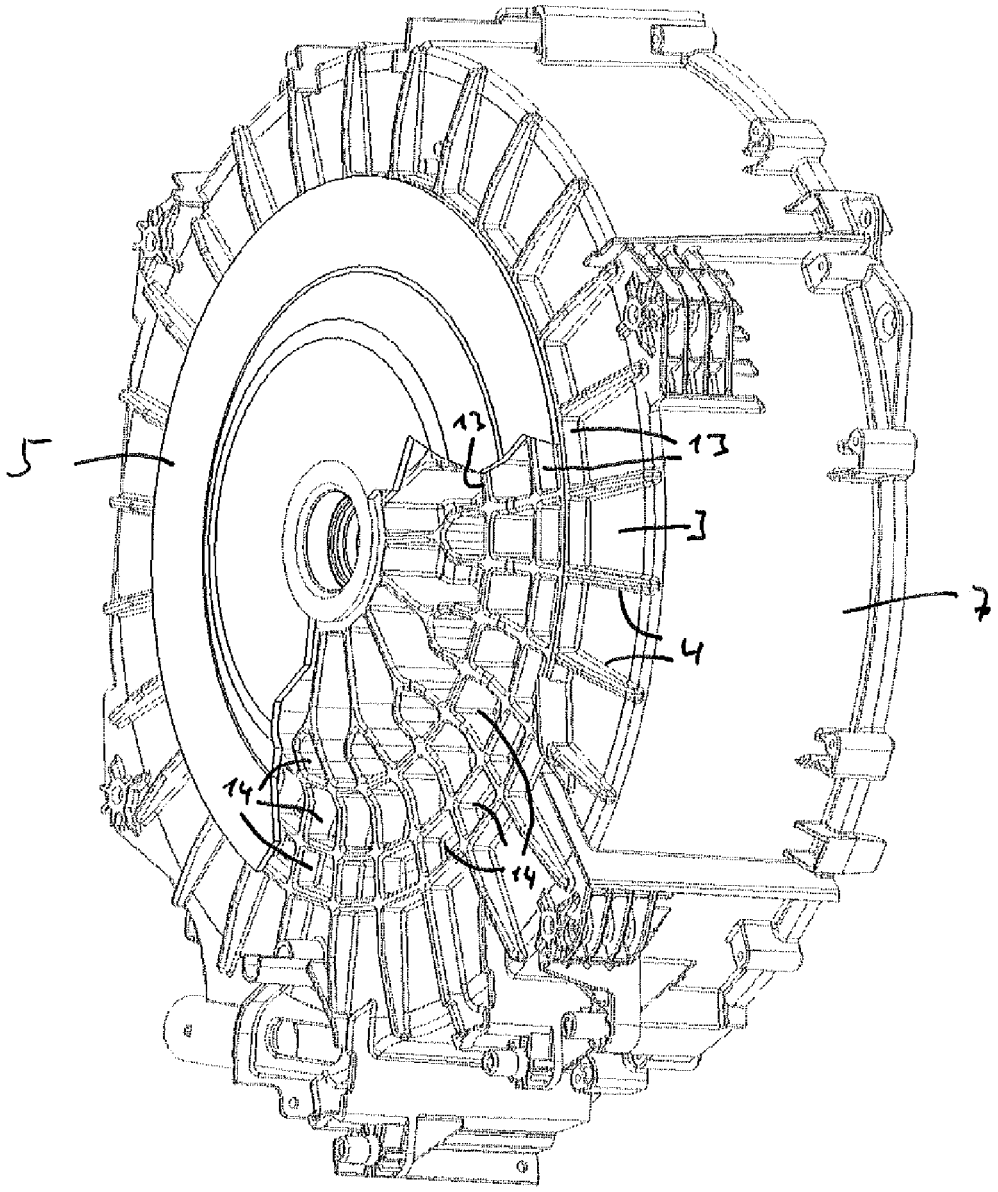
FIG. 8: the tub from FIG. 5, in an enlarged perspective view or with a partly cutaway stabilization component.

FIG. 4 shows the preferred embodiment variant of the end face wall 3 in a view from behind and above, in which the reinforcement ribs 4 branch once along their radial extent. The branching points 11 are each arranged at the same distance from the bearing mount 2.

Figure 2:
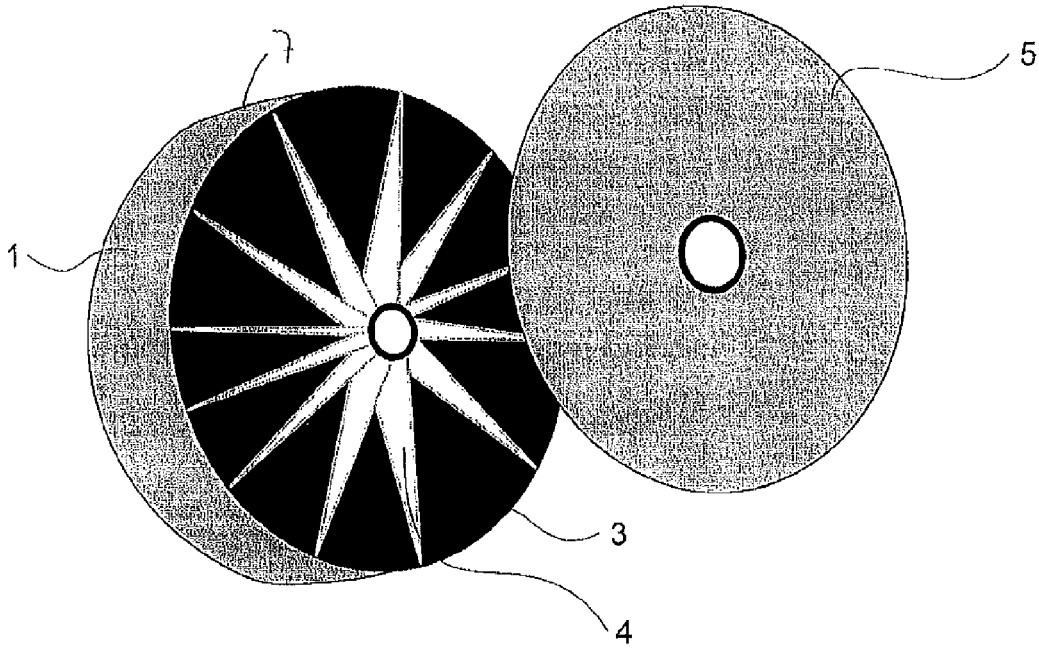
FIG. 2: a tub with a stabilization component in a perspective view, example 2.

The tub 1 shown in FIG. 2 differs from the first example in that the reinforcement ribs 4 are a component of the end face wall 3 and are molded into the latter during injection molding. The stabilization component 5 made from the more solid plastic does not have any ribs. It is in the nature of things for the tub 1 to have a lower rigidity compared to the exemplary embodiment shown in FIG. 1. This embodiment is suitable for smaller tubs 1 which accommodate smaller loads.

Figure 3:
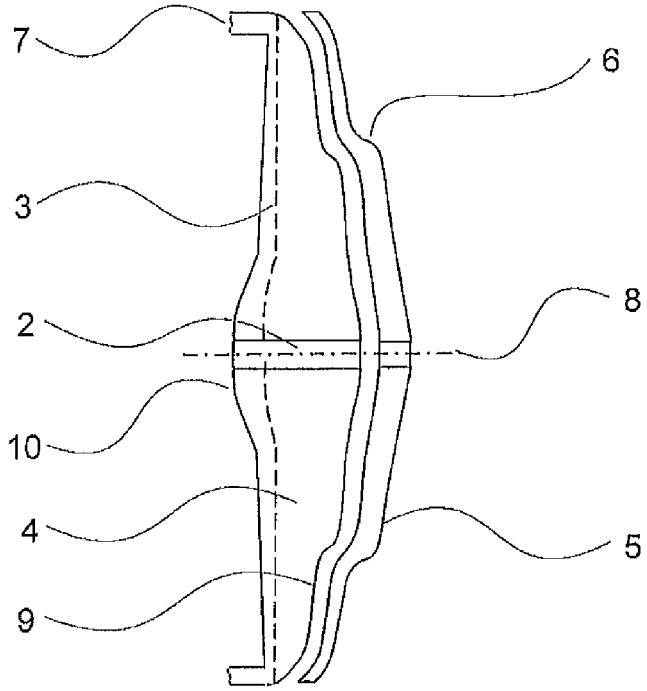
FIG. 3: a tub with a stabilization component in a cross-sectional diagram.

A preferred embodiment of the tub 1 is shown in a cross-sectional view in FIG. 3. As in example 2 the reinforcement ribs 4 are a component of the end face wall 3. The shape of the reinforcement ribs 4 differs from the triangular shape in example 2 and is designed in accordance with the overall construction of the washing machine. The curved section 10 extending into the drum means that the bearing mount 2 is extended without the capacity of the L (lacuna) being significantly reduced. The shoulder 6 is intended to accommodate the belt pulley via which the washing drum is driven in a space-saving manner.

The wall thicknesses of the stabilization component 5 and of the end face wall 3, the latter being recognizable by the dashed line, reduce from the bearing mount 2 towards the edge. The different material thicknesses is a further means, taking into account a more efficient use of material, of increasing the stability of the components in some areas or restricting them to just the necessary dimension.

It can be seen from the drawing that the contours of the inner surface of the stabilization component 5 are molded in the same way to correspond to the line 9 of the back of the reinforcement ribs 4. The two components are plain jointed to each other and can be welded without any gaps along the line of contact. When the two components are joined the rotationally-symmetrical stabilization component 5 is positioned in a simple manner over the bearing mount 2. Further positioning aids are not required.

FIGS. 5 to 8 show a third example for a tub 1, with just one half of the tub 1, which especially forms the rear half of a complete tub 1, being shown. The half shown in the diagram is to be combined with a corresponding front half which has another end face wall with a correspondingly enlarged opening for the necessary access to a washing drum to be placed in the tub 1. Thus FIGS. 5 to 8 will thus now be referred to together.

The half of the tub 1 shown comprises a central and essentially hollow-cylindrical and solid bearing mount 2 in the end face wall 3 which accepts a bearing housing 12 consisting of gray cast iron. The appropriate bearings for supporting a shaft which is used to drive said laundry drum would be placed in the bearing housing 12. All parts of the tub 1 except for the bearing housing 12 consist of an injection-molded plastic. The casing 7 adjoins the end face wall 3 in the known way. On the outer side of the casing 7 there are various moldings for accommodating the further components of the washing machine or of the washer/dryer to which the tub 1 belongs. These items are not of importance to the present invention and no further reference to them will thus be made here.

On the outside the end face wall 3 bears radial reinforcement ribs 4 which extend from the bearing mount 2 out to the casing 7, and also a plurality of circumferential reinforcement ribs 13. The stabilization component is placed on both the radial ribs 4 and also on these circumferential ribs 13 and is welded to all of these so that between the end face wall 3 and the stabilization component 5 enclosed compartments 14 are formed delimited by the radial ribs 4 and circumferential ribs 13, possibly also by the bearing mount 2. In the area of the bearing mount 2 such compartments 14 are produced by the stabilization component 5 being in contact with the bearing mount 2 directly and also being welded to the latter. This is of great importance for the solidity of the entire arrangement since in this way a lenticular space is formed between the stabilization component and the end face wall 3 divided into the individual compartments 14 and otherwise only penetrated by the bearing mount 2. This makes a great contribution to the stability and the solidity of the end face wall 3 and of the overall tub 1, since in this manner both the end face wall 3 and also the associated ribs 4 and 13, as well as the stabilization component 5 jointly accommodate the forces emanating from the bearing housing 12 during the operation of the washing machine. Thus—even with a significant saving in plastic material compared to a structure for the end face wall 3 which could manage without a stabilization component 5—a highly stable structure and one that is excellently matched to the forces occurring during operation is achieved.

The stabilization component 5 can consist of the same material as the end face wall 3 and the casing 7, however it is also conceivable and under some circumstances very advantageous to use a more solid and more robust material for the stabilization component 5. In this way the solidity properties of the improved material can be exploited, with however the end face wall 3 and the casing 7 still able to be molded with a simpler material. In each case a tub 1 which can withstand especially high stresses and is cheap to manufacture can be achieved.

LIST OF REFERENCE SIGNS

1. Tub
2. Bearing mount
3. End face wall
4. Reinforcement ribs, radial
5. Stabilization component
6. Molded-in section/shoulder
7. Casing
8. Axis of the laundry drum
9. Rear contour line.
10. Curved section
11. Branch
12. Bearing housing
13. Reinforcement ribs, circumferential
14. Compartment

The invention claimed is:

1. A plastic suds tub for a washing machine comprising:

a cylindrical casing, an end face wall closing off the casing and formed with a hollow-cylindrical, solid bearing mount, said cylindrical casing and said end face wall being of one-piece construction formed of a first plastic material having a first modulus of elasticity;

a stabilizer attached to an exterior side of said end face wall; and reinforcement ribs molded into the stabilizer, said stabilizer and said reinforcement ribs formed of a second plastic material having a second modulus of elasticity higher than said first modulus of elasticity; said reinforcement ribs being radially-aligned from the bearing mount and branching along their respective radial extents.

2. The plastic suds tub of claim 1, wherein the stabilizer and the end face wall are welded to each other.

3. The plastic suds tub of claim 1, wherein the reinforcement ribs and the surfaces of the end face wall or of the stabilizer respectively are molded to correspond to one another such that the backs of the reinforcement ribs adjoin the opposing surface along their extent without any gaps and are welded to the latter.

4. The plastic suds tub of claim 1, wherein the reinforcement ribs further comprise circumferential reinforcement ribs in contact with the stabilizer.

5. The plastic suds tub of claim 4, wherein the bearing mount is also in contact with the stabilizer.

6. The plastic suds tub of claim 1, wherein the end face wall, bearing mount, the reinforcement ribs and the stabilizer define an enclosed compartment between them.

7. The plastic suds tub of claim 1 wherein said first plastic material is comprised of talc-reinforced polypropylene.

8. The plastic suds tub of claim 1 wherein said second plastic material comprises glass fiber-reinforced polypropylene.

9. The plastic suds tub of claim 8 wherein said second plastic material comprises glass fiber-reinforced polypropylene.

10. The plastic suds tub of claim 1, wherein the first plastic material and the second plastic material have a same polymer type.

11. The plastic suds tub of claim 1, further comprising a bearing housing disposed in the bearing mount, wherein the bearing housing is made from a third material.

12. The plastic suds tub of claim 11, wherein the third material is not plastic.

13. The plastic suds tub of claim 11, wherein the third material is cast iron.

14. A plastic suds tub for a washing machine comprising:

a unitary cylindrical casing and end face wall formed of a polypropylene plastic material having a first modulus of elasticity; said end face wall closing off the casing with a hollow-cylindrical, solid bearing mount;

a stabilizer affixed to an outside surface of the end face wall, said stabilizer having an inside surface shaped to substantially conform to said outside surface of said end face wall; and plastic reinforcement ribs molded into only one of the inside surface of the stabilizer and the outside surface of the end face wall, the reinforcement ribs extending radially from the bearing mount and branching into additional reinforcement ribs along their respective radial extents, said stabilizer formed of a second glass fiber-reinforced polypropylene plastic material having a second modulus of elasticity greater than said first modulus of elasticity.

15. The plastic suds tub of claim 14, wherein the reinforcement ribs and said one of the inside surface of stabilizer and outside surface of the end face wall, respectively are molded to correspond to one another such that the backs of the reinforcement ribs adjoin an opposing stabilizer or end face wall surface along their extent without any gaps and are welded to the latter.

16. The plastic suds tub of claim 14, wherein the reinforcement ribs further comprise circumferential reinforcement ribs in contact with the stabilizer.

17. The plastic suds tub of claim 16, wherein the bearing mount is also in contact with the stabilizer.

18. The plastic suds tub of claim 14, wherein the end face wall, bearing mount, the reinforcement ribs and the stabilizer define an enclosed compartment between them.

19. The plastic suds tub of claim 14, further comprising a bearing housing disposed in the bearing mount, wherein the bearing housing is made from a third material.

20. The plastic suds tub of claim 19, wherein the third material is not plastic.

21. The plastic suds tub of claim 19, wherein the third material is cast iron.

* * * * *